US005836178A

United States Patent [19]

Ando'

[11] Patent Number: 5,836,178

[45] Date of Patent: Nov. 17, 1998

[54] MODIFIED NEEDLE WITH ASSOCIATED ACTUATION ELEMENTS FOR KNITTING THE HEEL IN CIRCULAR STOCKING MACHINES

[75] Inventor: Jan Ando', Scandicci, Italy

[73] Assignee: Matec S.r.l., Scandicci, Italy

[21] Appl. No.: 868,207

[22] Filed: Jun. 2, 1997

[30] Foreign Application Priority Data

Aug. 1, 1996 [IT] Italy ..... BO96A0421

[51] Int. Cl.[6] ..... D04B 35/02

[52] U.S. Cl. ..... 66/123; 66/219

[58] Field of Search ..... 66/123, 215–219

[56] References Cited

U.S. PATENT DOCUMENTS

| | | | |
|---|---|---|---|
| 3,892,108 | 7/1975 | Hadam | 66/123 X |
| 4,715,198 | 12/1987 | Ploppa et al. | 66/219 X |
| 5,070,711 | 12/1991 | Gargiani | 66/219 |
| 5,520,024 | 5/1996 | Ando | 66/219 X |
| 5,568,738 | 10/1996 | Wang | 66/219 X |
| 5,664,442 | 9/1997 | Ando | 66/219 X |

OTHER PUBLICATIONS

Groz–Beckert Needles of High Precision, Advertising publication, (see p. 42, No. 177 and 179 and p. 45, No. 18).

*Primary Examiner*—John J. Calvert
*Attorney, Agent, or Firm*—Welsh & Katz, Ltd.

[57] ABSTRACT

A modified needle with associated actuation elements or knitting the heel in circular stocking machines, comprising a first conventional selection heel and an elastic extension having a second heel that can be selected for forming the sock and stocking toe and heel, the respective actuation elements being distributed independently of one another along two corresponding annular bands of the cylinder arranged at different levels.

3 Claims, 3 Drawing Sheets

FIG.1
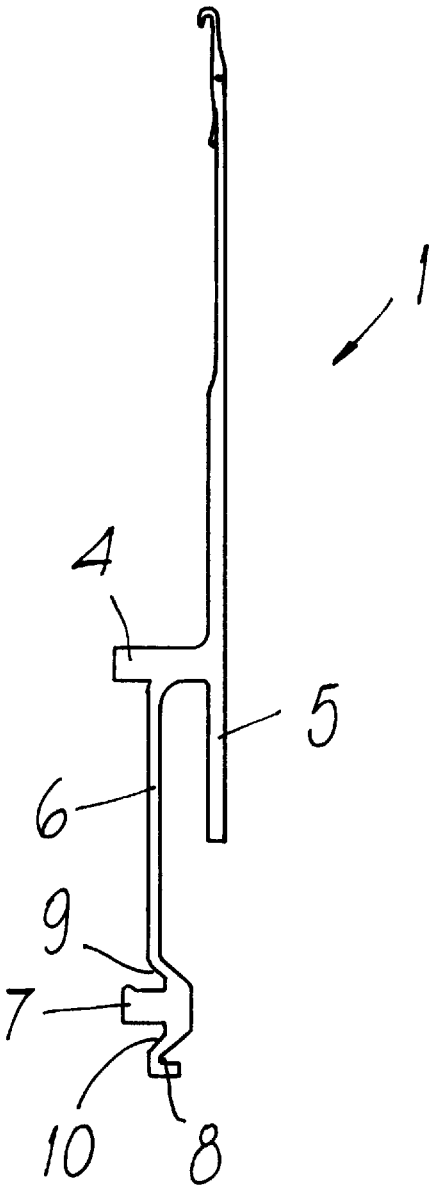
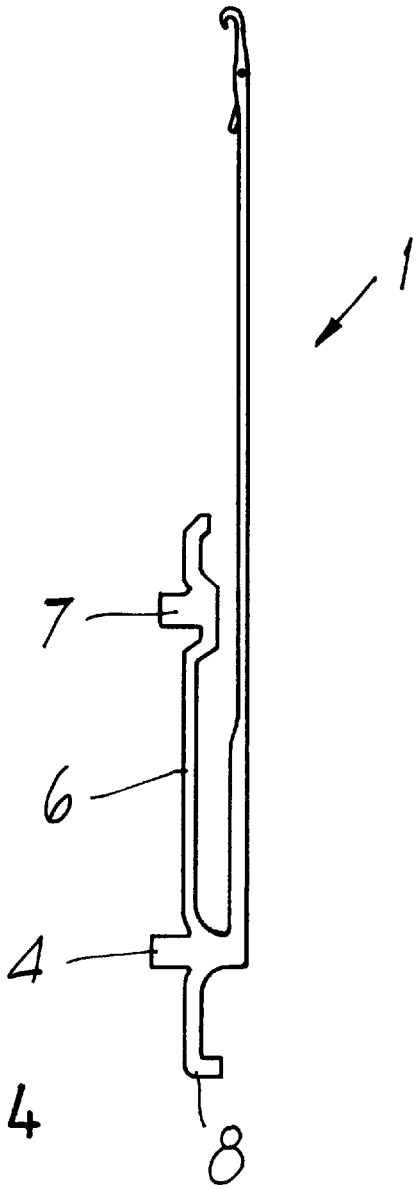
FIG.4

MODIFIED NEEDLE WITH ASSOCIATED ACTUATION ELEMENTS FOR KNITTING THE HEEL IN CIRCULAR STOCKING MACHINES

BACKGROUND OF THE INVENTION

The present invention relates to a modified needle with associated actuation elements for knitting the heel in circular stocking machines.

Conventional circular stocking machines also form the heel and the toe: in order to do this, the knitting machine must be able to cast on and off; this is achieved by means of the alternating motion system, wherein only the short-heeled needles are alternated, in forming the knitting, on the two casting-off cams of the first drop in the direction of motion assumed by the cylinder.

In the known art, the needles have a selection heel which can be actuated both to form the heel and toe of a sock or stocking and to form the knitting stitches: in the region of the cylinder which is affected by the triangles, pins, or countercams meant to provide, through the alternating motion of the cylinder, the actuation of the needle heels to form the toe and the heel, there is no room for needle selection elements meant to form pattern stitches.

In practice, at the large sector of the cylinder which is meant to select the needles for knitting the heel and the toe it is not possible to perform selections meant for other knitting operations.

SUMMARY OF THE INVENTION

A principal aim of the present invention is to obviate the mentioned drawbacks of conventional needles, i.e., to provide a modified needle with associated actuation elements for knitting the heel in circular stocking machines which allows to perform selections also at the region of the cylinder which is affected by the pins, triangles and countercams for forming the heel and the toe.

Within the scope of this aim, an object of the present invention is to achieve the above aim with a structure which is simple, relatively easy to provide in practice, safe in use, effective in operation, and has a relatively low cost.

This aim and this object are both achieved by the present modified needle with associated actuation elements for knitting the heel in circular stocking machines, characterized in that it comprises a first conventional selection heel and an elastic extension having a second heel that can be selected for forming the sock and stocking toe and heel, the respective actuation elements being distributed independently of one another along two corresponding annular bands of the cylinder arranged at different levels.

BRIEF DESCRIPTION OF THE DRAWINGS

Further characteristics and advantages of the present invention will become apparent and evident from the following detailed description of a preferred but not exclusive embodiment of a modified needle with associated actuation elements for knitting the heel in circular stocking machines according to the invention, illustrated only by way of non-limitative example in the accompanying drawings, wherein:

FIG. 1 is a side view of a modified needle for knitting the heel in circular stocking machines according to the present invention;

FIG. 4 is a side view of an alternative embodiment of the needle of FIG. 1.

DESCRIPTION OF THE PREFERRED EMBODIMENTS

Figure 2:
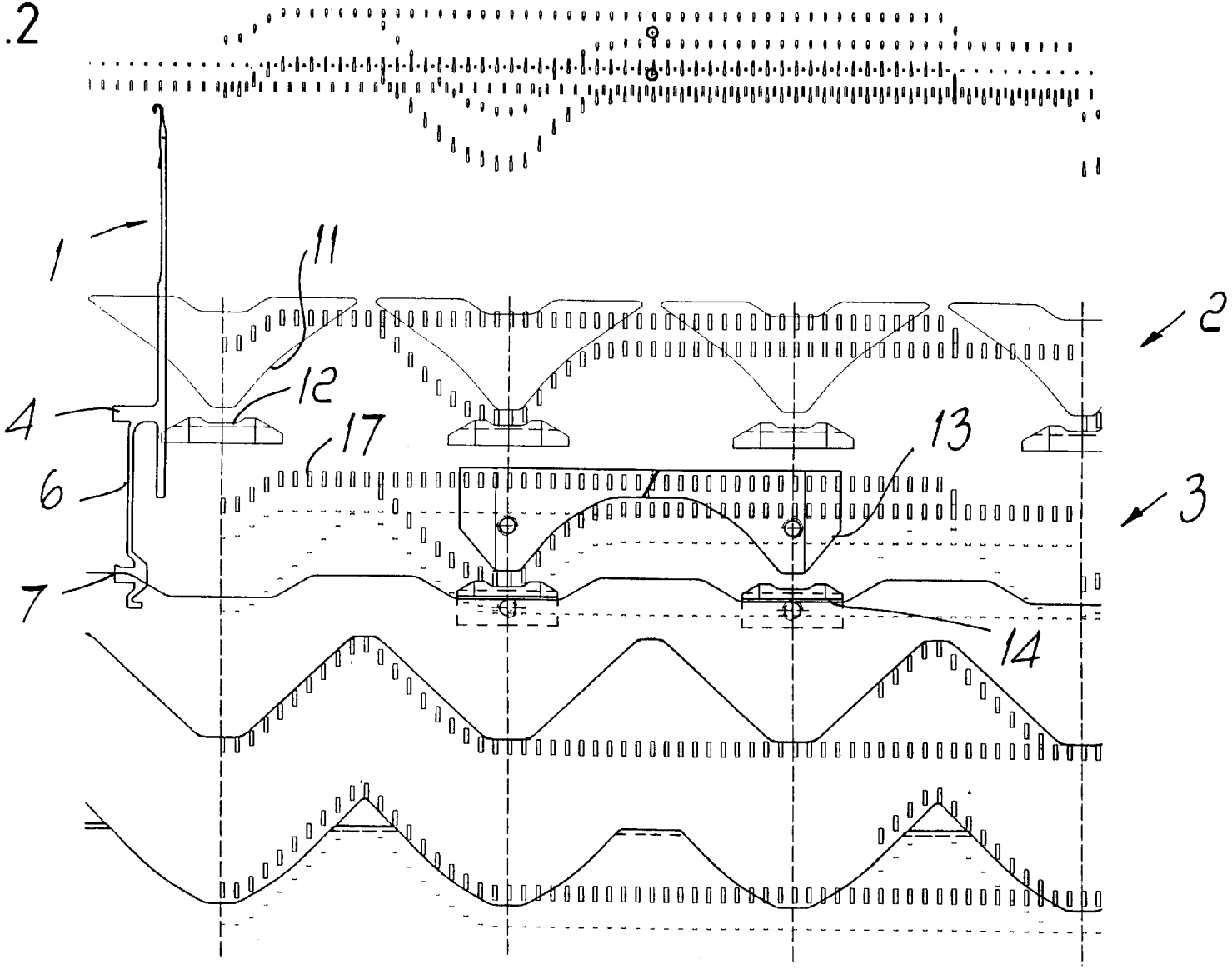
FIG. 2 is a schematic flattened view of the needle actuation elements.

With particular reference to the above figures, the reference numeral 1 generally designates a modified needle and the reference numerals 2 and 3 designate the corresponding actuation elements for knitting the heel in circular stocking machines according to the present invention.

The needle 1, in the embodiment illustrated in FIG. 1, has a first conventional selection heel 4, below which there are provided a tab 5, aligned with the needle for guiding in the cylinder, and an elastic extension 6.

The extension 6 has, in a downward region, a second heel 7 which can be selected to form the toe and heel of the sock or stocking and a tip 8 for supporting the sub-needle, two trapezoidal notches 9 and 10 being advantageously present above and below the heel 7.

The elements for actuating the two heels 4 and 7 are distributed independently of one another along two corresponding annular bands of the cylinder which are arranged at different levels: in the band 2 there are provided cams 11 and countercams 12 meant to form the knitting, whilst in the band 3 there are provided cams 13, countercams 14, triangles 15, and pins 16 meant to actuate the heel 7 to form the toe and the heel.

The embodiment of FIG. 2 illustrates a circular machine which can select in both directions of rotation: the reference numeral 17 designates the cast-off level.

Figure 3:
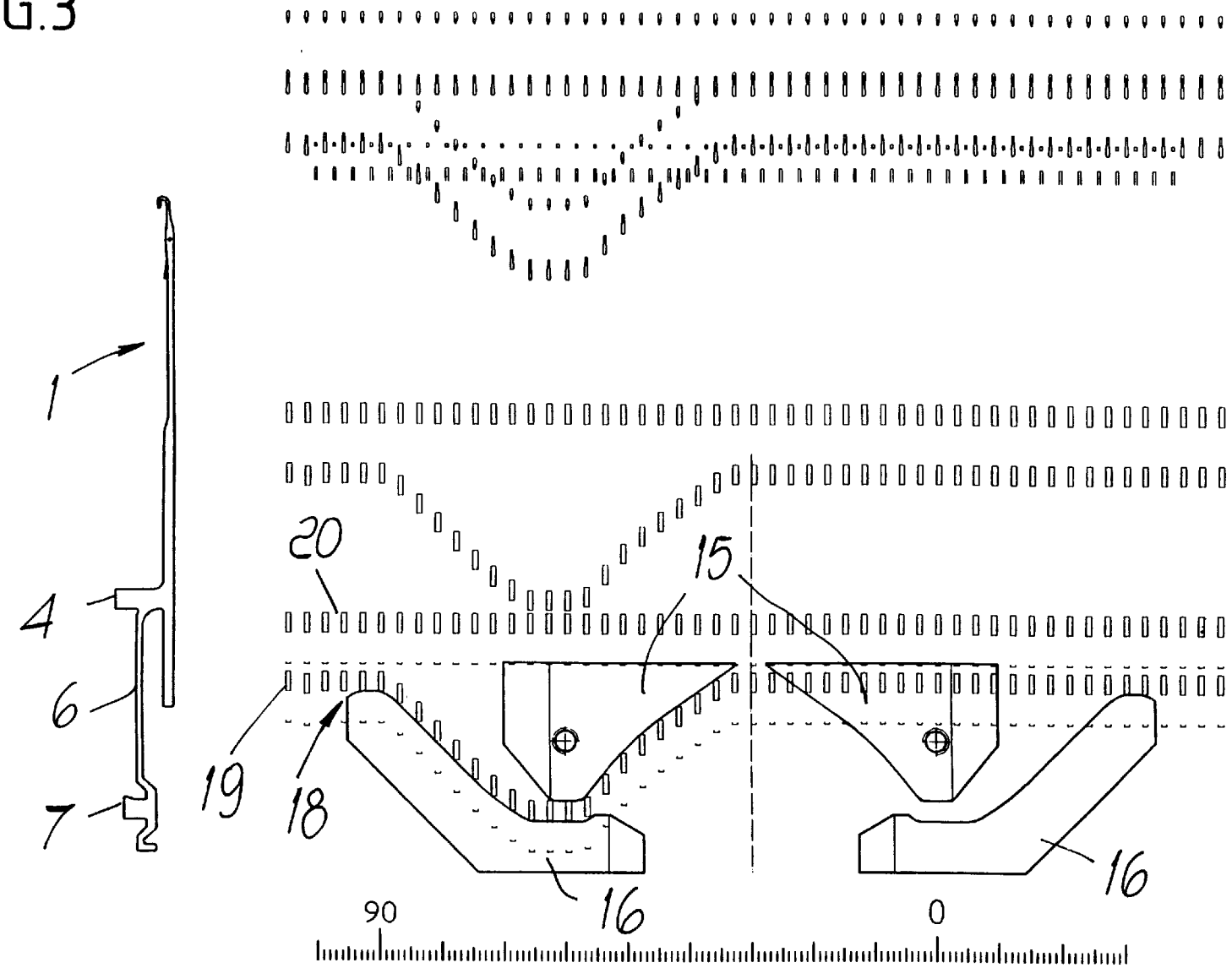
FIG. 3 is a schematic flattened view of the needle actuation elements in an embodiment which is alternative to the one shown in FIG. 2.

The embodiment illustrated in FIG. 3 shows a circular machine which cannot select in both directions of rotation: a picker is provided in the position designated by the reference numeral 18, the reference numeral 19 designates the cast-off level, and the reference numeral 20 designates a higher level than the cast-off level.

In the embodiment of the needle shown in FIG. 4, the locations of the first and of the second heels are swapped: in practice, in the needle 1 the first conventional selection heel 4 is in a downward region and thereabove an elastic extension 6 is provided which bears the second heel; accordingly, the positions of the respective actuation elements, not shown in the figure, must be swapped accordingly from the top to the bottom.

The operation of the modified needle is evident: since the selections of the knitting and the selections of the toe and heel are performed with heels and actuation elements located in different spatial bands, said selections are absolutely independent of each other.

It has thus been observed that the present invention achieves the intended aim and object.

The invention thus conceived is susceptible of numerous modifications and variations, all of which are within the scope of the inventive concept.

All the details may also be replaced with other technically equivalent ones.

In practice, the materials employed, as well as the shapes and the dimensions, may be any according to requirements without thereby abandoning the scope of the protection of the appended claims.

What is claimed is:

1. In a circular knitting machine with a needle cylinder, a needle selection combination comprising a modified needle with associated actuation elements for knitting sock and stocking heels and toes, the needle comprising: a first selection needle heel; an elastic extension extending from said first selection needle heel; and a second selection needle heel attached at said elastic extension; said actuation elements comprising first actuation elements and second actuation elements for actuating respectively said first and second needle heels, said first and second actuation elements being distributed independently of one another along two corresponding annular bands of the circular knitting machine cylinder, said bands being arranged at different levels.

2. The needle selection combination according to claim 1, wherein said elastic extension provided with the second heel protrudes below said first heel.

3. The needle selection combination according to claim 1, wherein said elastic extension provided with the second heel protrudes above said first heel.

* * * * *